US006009776A

United States Patent [19]

Warren

[11] Patent Number: 6,009,776

[45] Date of Patent: Jan. 4, 2000

[54] RIGHT ANGLE RATCHET WRENCH DRIVE UNIT

[76] Inventor: Kenneth R. Warren, 289 Henry Hall Rd., Covington, Tenn. 38019

[21] Appl. No.: 09/139,939

[22] Filed: Aug. 25, 1998

[51] Int. Cl.[7] ..... B25B 17/00

[52] U.S. Cl. ..... 81/57.29; 81/57.13

[58] Field of Search ..... 81/57.12, 57.28, 81/57.13, 177.85

[56] References Cited

U.S. PATENT DOCUMENTS

| | | | |
|---|---|---|---|
| 2,694,953 | 11/1954 | Williams | 81/57.29 |
| 2,716,363 | 8/1955 | Wasylow | 81/57.29 |
| 4,455,896 | 6/1984 | Holmes | 81/57.26 |
| 4,620,458 | 11/1986 | Schmidek | 81/177.85 |
| 4,813,308 | 3/1989 | Petrus | 81/57.29 |
| 4,913,007 | 4/1990 | Reynolds | 81/57.29 |
| 5,752,418 | 5/1998 | Robins | 81/177.85 |

*Primary Examiner*—James G. Smith
*Assistant Examiner*—Lee Wilson

[57] ABSTRACT

A right angle ratchet wrench drive unit comprised of a drive unit formed in an L-shaped orientation. The drive unit has a first end and a second end each having recesses. Each recess has an axis positioned at a ninety degree angle with respect to each other. The second recess has an internal cylindrical recess extending coaxially inwardly of its inboard end. The internal cylindrical recess has a pair of diametrically opposed spring-biased detents therein. First and second gear assemblies are positioned within the recesses. Each gear assembly includes a bevel gear having teeth and a central shaft. Each central shaft is formed in a generally cylindrical configuration with an inner end and an outer end. The outer end of the central shaft of the second gear assembly has a shoulder portion disposed thereon. The shoulder portion has a gear post extending coaxially therefrom. The bevel gear of the second gear assembly is positioned around the gear post. The bevel gears are received within the respective first and second recesses with the gear post being positioned within the internal cylindrical recess and engaged by the spring-biased detents. In a fully assembled orientation, the teeth of the bevel gears are positioned in a meshing relationship with respect to each other. A drive shaft is coupled to the outer end of the central shaft of the second gear assembly. The drive shaft is couplable within a socket.

6 Claims, 3 Drawing Sheets

RIGHT ANGLE RATCHET WRENCH DRIVE UNIT

BACKGROUND OF THE INVENTION

1. Field of the Invention

The present invention relates to a right angle ratchet wrench drive unit and more particularly pertains to transferring the turning direction of a ratchet tool head ninety degrees with respect to its standard direction.

2. Description of the Prior Art

The use of ratchet tools is known in the prior art. More specifically, ratchet tools heretofore devised and utilized for the purpose of tightening and loosening bolts are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,455,896 to Holmes discloses a wrench structure.

U.S. Pat. No. 4,813,308 to Petrus discloses a tool adapter and method of using same.

U.S. Pat. No. 4,913,007 to Reynolds discloses a right angle extension tool.

U.S. Pat. No. 4,474,089 to Scott discloses a screw handle ratchet.

U.S. Pat. No. 5,142,952 to Putney discloses a ratchet tool.

U.S. Pat. No. Des. 245,395 to Cognevich discloses a drive adapter for sockets and the like.

U.S. Pat. No. 1,312,889 to Brown, U.S. Pat. No. 1,301,472 to Macecevk, U.S. Pat. No. 2,694,953 to Williams, U.S. Pat. No. 2,716,363 to Wasylow and U.S. Pat. No. 1,832,663 to Small disclose ratchet wrench devices.

While these devices fulfill their respective, particular objective and requirements, the aforementioned patents do not describe a right angle ratchet wrench drive unit for transferring the turning direction of a ratchet tool head ninety degrees with respect to its standard direction.

In this respect, the right angle ratchet wrench drive unit according to the present invention substantially departs from the conventional concepts and designs of the prior art, and in doing so provides an apparatus primarily developed for the purpose of transferring the turning direction of a ratchet tool head ninety degrees with respect to its standard direction.

Therefore, it can be appreciated that there exists a continuing need for new and improved right angle ratchet wrench drive unit which can be used for transferring the turning direction of a ratchet tool head ninety degrees with respect to its standard direction. In this regard, the present invention substantially fulfills this need.

SUMMARY OF THE INVENTION

In the view of the foregoing disadvantages inherent in the known types of ratchet tools now present in the prior art, the present invention provides an improved right angle ratchet wrench drive unit. As such, the general purpose of the present invention, which will be described subsequently in greater detail, is to provide a new and improved right angle ratchet wrench drive unit and method which has all the advantages of the prior art and none of the disadvantages.

To attain this, the present invention essentially comprises right angle ratchet wrench drive unit comprised of a drive unit formed in an L-shaped orientation. The drive unit has a first end and a second end each having recesses. Each recess has an axis positioned at a ninety degree angle with respect to each other. The second recess has an internal cylindrical recess extending coaxially inwardly of its inboard end. The internal cylindrical recess has a pair of diametrically opposed spring-biased detents therein. First and second gear assemblies are positioned within the recesses. Each gear assembly includes a bevel gear having teeth and a central shaft. Each central shaft is formed in a generally cylindrical configuration with an inner end and an outer end. The outer end of the central shaft of the second gear assembly has a shoulder portion disposed thereon. The shoulder portion has a gear post extending coaxially therefrom. The bevel gear of the second gear assembly is positioned around the gear post. The bevel gears are received within the respective first and second recesses with the gear post being positioned within the internal cylindrical recess and engaged by the spring-biased detents. In a fully assembled orientation, the teeth of the bevel gears are positioned in a meshing relationship with respect to each other. The respective axes of the bevel gears are positioned at ninety degree angles with respect to each other. A drive shaft is coupled to the outer end of the central shaft of the second gear assembly. The drive shaft is couplable within a socket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved right angle ratchet wrench drive unit which has all the advantages of the prior art ratchet tools and none of the disadvantages.

It is another object of the present invention to provide a new and improved right angle ratchet wrench drive unit which may be easily and efficiently manufactured and marketed.

It is a further object of the present invention to provide a new and improved right angle ratchet wrench drive unit which is of durable and reliable construction.

An even further object of the present invention is to provide a new and improved right angle ratchet wrench drive unit which is susceptible of a low cost of manufacture with regard to both materials and labor, and which accordingly is then susceptible of low prices of sale to the consuming public, thereby making such a right angle ratchet wrench drive unit economically available to the buying public.

Even still another object of the present invention is to provide a new and improved right angle ratchet wrench drive unit for transferring the turning direction of a ratchet tool head ninety degrees with respect to its standard direction.

Lastly, it is an object of the present invention to provide a new and improved right angle ratchet wrench drive unit comprised of a drive unit formed in an L-shaped orientation. The drive unit has a first end and a second end each having recesses. Each recess has an axis positioned at a ninety degree angle with respect to each other. The second recess has an internal cylindrical recess extending coaxially inwardly of its inboard end. The internal cylindrical recess has a pair of diametrically opposed spring-biased detents therein. First and second gear assemblies are positioned within the recesses. Each gear assembly includes a bevel gear having teeth and a central shaft. Each central shaft is formed in a generally cylindrical configuration with an inner end and an outer end. The outer end of the central shaft of the second gear assembly has a shoulder portion disposed thereon. The shoulder portion has a gear post extending coaxially therefrom. The bevel gear of the second gear assembly is positioned around the gear post. The bevel gears are received within the respective first and second recesses with the gear post being positioned within the internal cylindrical recess and engaged by the spring-biased detents. In a fully assembled orientation, the teeth of the bevel gears are positioned in a meshing relationship with respect to each other. The respective axes of the bevel gears are positioned at ninety degree angles with respect to each other. A drive shaft is coupled to the outer end of the central shaft of the second gear assembly. The drive shaft is couplable within a socket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
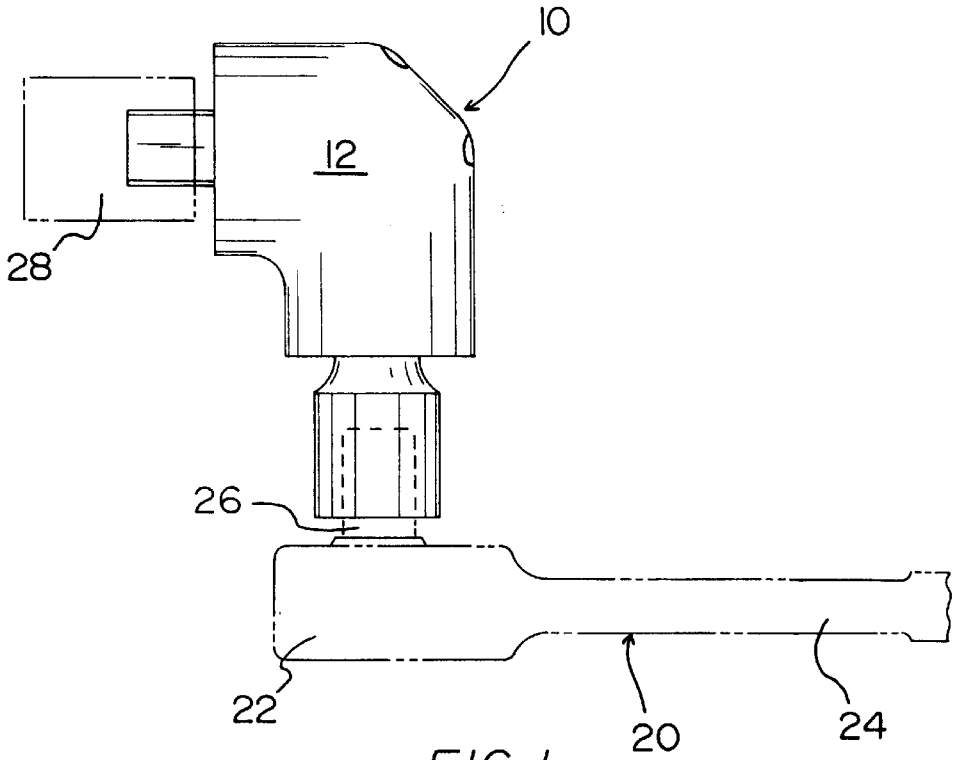
FIG. 1 is a perspective view of the preferred embodiment of the right angle ratchet wrench drive unit constructed in accordance with the principles of the present invention.
Figure 2:
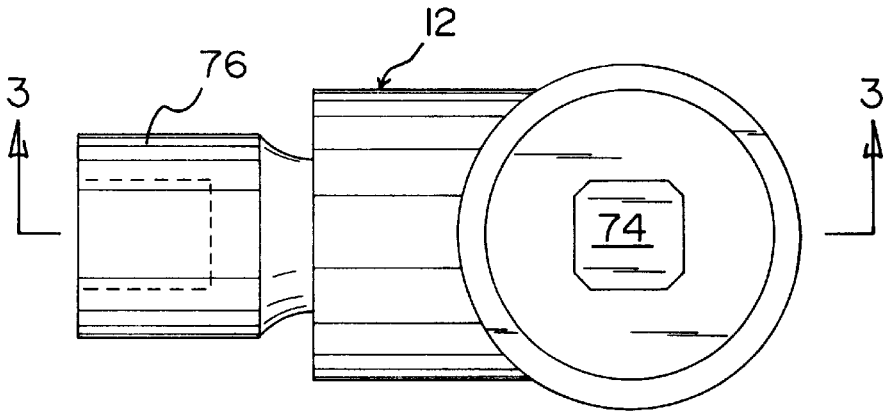
FIG. 2 discloses a perspective view of the adapter of the apparatus.
Figure 3:
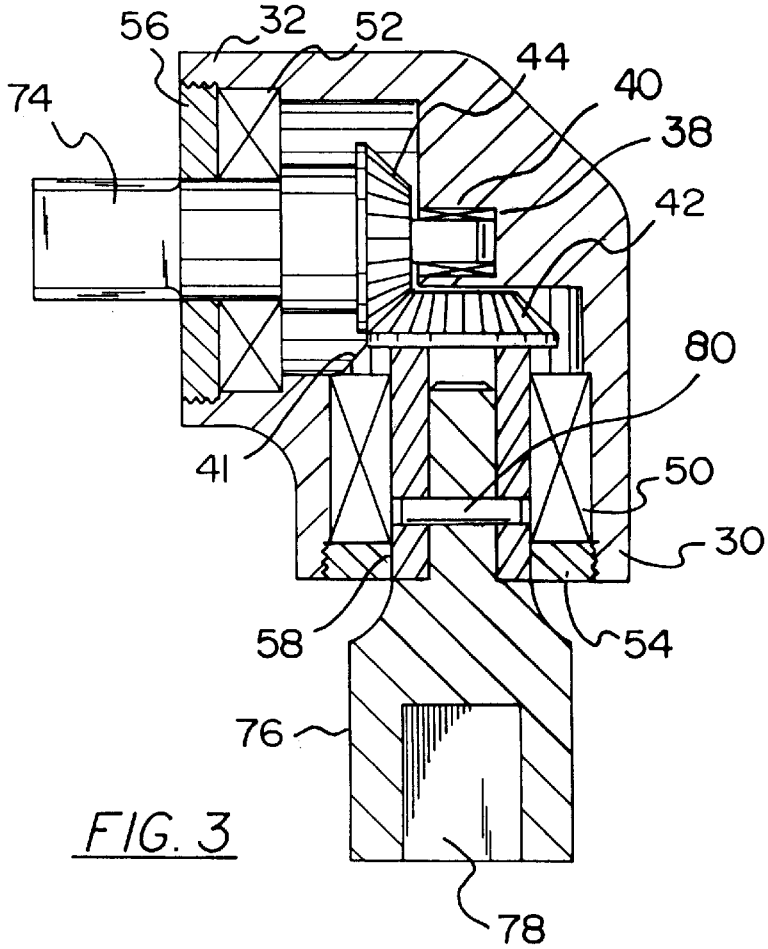
FIG. 3 discloses a cross-sectional view of the drive unit taken along section line 3—3 of FIG. 2.
Figure 4:
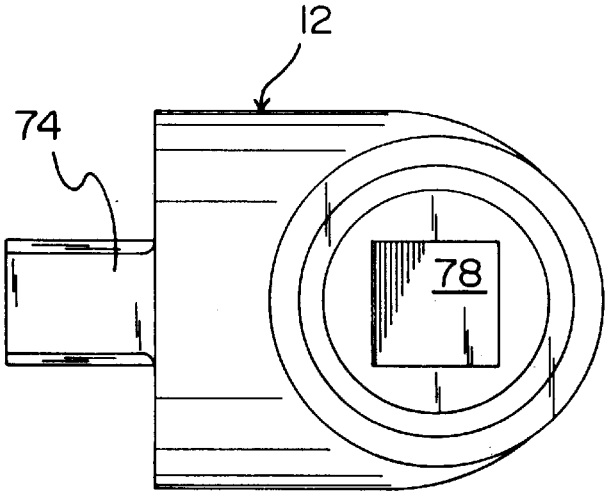
FIG. 4 discloses an isolated perspective view of the drive unit of the apparatus.
Figure 5:
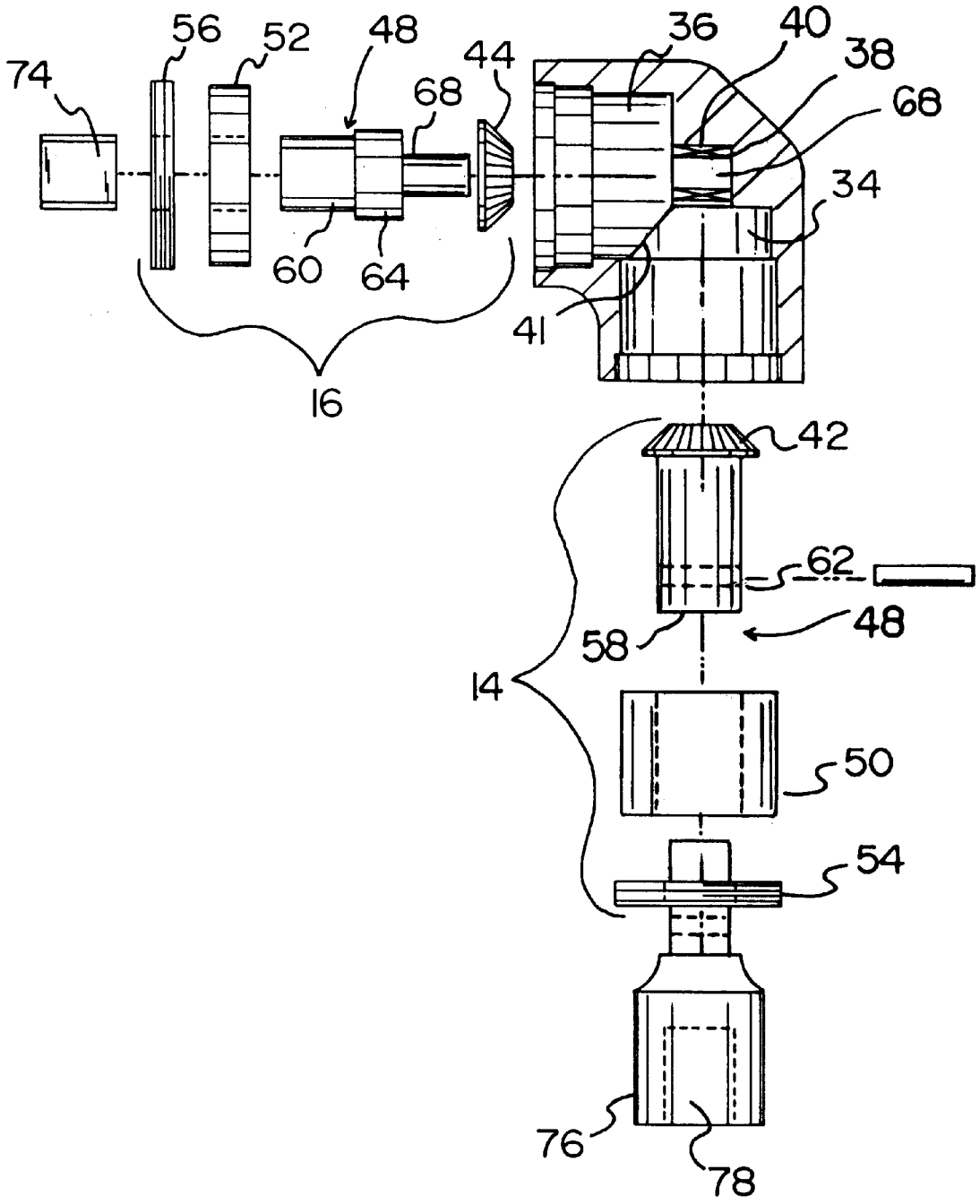
FIG. 5 discloses a separated perspective view illustrating the positioning of the various components of the apparatus with respect to each other.

With reference now to the drawings, and in particular, to FIGS. 1 through 5 thereof, the preferred embodiment of the new and improved right angle ratchet wrench drive unit embodying the principles and concepts of the present invention and generally designated by the reference number 10 will be described.

Specifically, it will be noted in the various Figures that the device relates to a new and improved right angle ratchet wrench drive unit 10. In its broadest context, the device consists of drive unit 12, first and second gear assemblies 14, 16 and an adapter 76. Such components are individually configured and correlated with respect to each other so as to attain the desired objective.

The right angle ratchet wrench drive unit 10 is essentially an adapter device for a ratchet wrench that is designed to transfer the turning direction of the tool head to a right angle from its standard direction. The apparatus allows a mechanic to work more easily in confined spaces, and enable him to reach bolts that are otherwise inaccessible.

A ratchet wrench 20 is included in the preferred embodiment of the apparatus. The ratchet wrench has a head 22 and an elongated handle 24. The head includes a generally rectangular shaped ratchet shaft 26 extending from it. In alternate embodiments of the apparatus a wrench is not included. Note FIG. 1.

A socket 28 is also included in the preferred embodiment of the apparatus. The socket is formed in a cylindrical configuration with a first end including a rectangular bore and a second end including a hexagonal bore. In alternate embodiments of the apparatus a plurality of differently sized sockets are included. Note FIG. 1.

The drive unit 12 is formed in a generally cylindrical configuration and contoured in a generally L-shaped orientation. The drive unit has a first end 30 and a second end 32. The drive unit is fabricated of steel in the preferred embodiment. First and second recesses 34, 36 are formed in a generally cylindrical orientation and are positioned within each respective end. Each recess has an inboard portion and an outboard portion. The outboard portions each include internal screw threads in the preferred embodiment. The first and second recesses each have an axis positioned at a ninety degree angle with respect to the other axis. The second recess 36 has an internal cylindrical recess 38 extending coaxially inwardly of its inboard end. The internal cylindrical recess 38 has a pair of diametrically opposed spring biased detents 40 therein. The recesses 34, 36 are in communication with each other at intersection 41. Note FIGS. 3 and 5.

The first and second gear assemblies 14, 16 are positioned within the first and second recesses respectively. Each gear assembly comprises a bevel gear 42, 44, a central shaft 46, 48, a bearing member 50, 52 and a retaining member 54, 56. Each central shaft is formed in a generally cylindrical configuration with an outer end 58, 60. The outer end 60 of the second gear assembly 16 has a shoulder portion 64 disposed thereon. The shoulder portion 64 has a gear post 68 extending outwardly therefrom in a colinear relationship. Each bevel gear has an inboard end, an outboard end, an outer wall including a plurality of teeth and an axial aperture. The diameter of the outboard end of each bevel gear is greater than that of the inboard end with a gradually decreasing diameter therebetween. The outer wall of each bevel gear is angled at about forty five degrees with respect to the inboard and outboard ends. In the fully assembled operative orientation the outer walls and teeth of the bevel gears are in meshing contact thereby forming ninety degree angle with respect their axes. Note FIG. 3.

The bevel gear 44 of the second gear assembly 16 is secured around the gear post 68. The bevel gears 42,44 are received within the respective first and second recesses 34, 36 with the gear post 68 positioned within the internal recess 38 and engaged by the spring biased detents 40. Each bearing is formed in a generally cylindrical configuration and includes an axial aperture positioned around the outer end of the central shaft flush with the shoulder portion. Each retaining member 54, 56 includes an axial aperture and peripheral coupling means. In the preferred embodiment the peripheral coupling means are screw threads adapted to threadedly couple with the internal screw threads of the drive unit. Each retaining member is coupled within the outer portion of a recess to secure the gear assemblies in place. In a fully assembled orientation the teeth of the bevel gears are positioned in a meshing relationship with respect to each other within the intersection 41. The respective axes of the bevel gears are positioned at ninety degree angles with respect to each other. Since the bevel gears are the same size, have the same shape and number of teeth, the resulting gear ratio is one to one. Note FIG. 3.

A drive shaft 74 is coupled to the outer end 60 of the central shaft of the second gear assembly. The drive shaft is couplable within the socket 28. An adapter 76 has a first end including a rectangular bore 78 and a second end which is coupled to the outer end 58 of the central shaft of the first gear assembly. The adapter 76 has a horizontal bore therethrough that aligns with a horizontal bore 62 through the central shaft 46 for receiving a pin 80 therethrough to facilitate secure coupling of the adapter 76 to the first gear assembly 14. In an operative orientation a user positions the ratchet shaft 26 within the rectangular bore 78 of the adapter and turns the wrench 20. This action causes rotation of the bevel gears 42, 44 and drive shaft 74. The net effect is that the apparatus transfers the turning direction of the ratchet tool head ninety degrees with respect to its standard direction. Note FIGS. 2, 4 and 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A right angle ratchet wrench drive unit comprising, in combination:

a ratchet wrench having a head and an elongated handle, the head including a generally rectangular shaped ratchet shaft extending therefrom;

a socket formed in a cylindrical configuration with a first end including a rectangular bore and a second end including a hexagonal bore;

a drive unit formed in a generally cylindrical configuration and contoured in a generally L-shaped orientation, the drive unit having a first end and a second end, first and second recesses being formed in a generally cylindrical orientation and being positioned within each respective end, each recess having an inboard portion and an outboard portion, the first and second recesses each having an axis positioned at a ninety degree angle with respect to each other, the second recess having an internal cylindrical recess extending coaxially inwardly of its inboard end, the internal cylindrical recess having a pair of diametrically opposed spring-biased detents therein;

first and second gear assemblies positioned within the first and second recesses respectively, the first and second gear assemblies thus being at a ninety degree angle with respect to one another, each gear assembly comprising a bevel gear, a central shaft, a bearing member and a retaining member, each central shaft being formed in a generally cylindrical configuration with an outer end, the outer end of the central shaft of the second gear assembly having a shoulder portion disposed thereon, the shoulder portion having a gear post extending coaxially therefrom, each bevel gear having an inboard end, an outboard end, an outer wall including a plurality of teeth and an axial aperture, the diameter of the outboard end of each bevel gear being greater than that of the inboard end with a gradually decreasing diameter therebetween, the outer wall being angled at about forty five degrees with respect to the inboard and outboard ends, the bevel gear of the second gear assembly being positioned around the gear post, the bevel gears being received within the respective first and second recesses with the gear post being positioned within the internal cylindrical recess and engaged by the spring-biased detents, each bearing being formed in a generally cylindrical configuration including an axial aperture positioned around the outer end of the central shaft flush with the shoulder portion, each retaining member including an axial aperture and peripheral coupling means, each retaining member being coupled within the outer portion of a recess to secure the gear assemblies in place, in a fully assembled orientation the teeth of the bevel gears being positioned in a meshing relationship with respect to each other, the respective axes of the bevel gears being positioned at ninety degree angles with respect to each other; and a drive shaft being coupled to the outer end of the central shaft of the second gear assembly, the drive shaft being detachably coupled within the socket, an adapter with a first end having a rectangular bore for receiving the ratchet shaft and a second end having a rectangular bore for being detachably coupled to the outer end of the central shaft of the first gear assembly, the adapter having a horizontal bore therethrough aligning with a horizontal bore through the central shaft of the first gear assembly, a pin extending through the aligned horizontal bores to facilitate secure coupling of the adapter to the first gear assembly, in an operative orientation a user positioning the ratchet shaft within the rectangular bore of the adapter and turning the wrench, this action causing rotation of the bevel gears and rectangular drive shaft, wherein the adapter has a tapered portion formed in an end thereof.

2. A right angle ratchet wrench drive unit comprising:

a drive unit formed in an L-shaped orientation, the drive unit having a first end and a second end each having recesses, each recess having an axis positioned at a ninety degree angle with respect to each other, the second recess having an internal cylindrical recess extending coaxially inwardly of its inboard end, the internal cylindrical recess having a pair of diametrically opposed spring-biased detents therein;

first and second gear assemblies positioned within the recesses, each gear assembly including a bevel gear having teeth and a central shaft, each central shaft being formed in a generally cylindrical configuration with an inner end and an outer end, the outer end of the central shaft of the second gear assembly having a shoulder portion disposed thereon, the shoulder portion having a gear post extending coaxially therefrom, the bevel gear of the second gear assembly being positioned around the gear post, the bevel gears being received within the respective first and second recesses with the gear post being positioned within the internal cylindrical recess and engaged by the spring-biased detents, in a fully assembled orientation the teeth of the bevel gears being positioned in a meshing relationship with respect to each other, the respective axes of the bevel gears being positioned at ninety degree angles with respect to each other; and a drive shaft being coupled to the outer end of the central shaft of the second gear assembly, the drive shaft being couplable within a socket.

3. The right angle ratchet wrench drive unit as set forth in claim 2 wherein each bevel gear has an inboard end, an outboard end, an outer wall and an axial aperture, the teeth being positioned around the outer wall, the diameter of the outboard end of each bevel gear being greater than that of the inboard end with a gradually decreasing diameter therebetween, the outer wall being angled at about forty five degrees with respect to the inboard and outboard ends.

4. The right angle ratchet wrench drive unit as set forth in claim 2 and further including:

a ratchet wrench having a head and an elongated handle, the head including a generally rectangular shaped ratchet shaft extending therefrom; and a socket formed in a cylindrical configuration with a first end including a rectangular bore and a second end including a hexagonal bore.

5. The right angle ratchet wrench drive unit as set forth in claim 4 and further including:

an adapter with a first end having a rectangular bore for receiving the ratchet shaft and a second end having a rectangular bore for being detachably coupled to the outer end of the central shaft of the first gear assembly.

6. The right angle ratchet wrench drive unit as set forth in claim 5 wherein the adapter has a horizontal bore therethrough aligning with a horizontal bore through the central shaft of the first gear assembly, a pin extending through the aligned horizontal bores to facilitate secure coupling of the adapter to the first gear assembly, in an operative orientation a user positioning the ratchet shaft within the rectangular bore of the adapter and turning the wrench, this action causing rotation of the bevel gears and drive shaft, wherein the adapter has a tapered portion formed in an end thereof.

* * * * *